US010282921B2

(12) United States Patent
Joo et al.

(10) Patent No.: US 10,282,921 B2
(45) Date of Patent: May 7, 2019

(54) SYSTEM FOR MANAGING MOBILE VEHICLE

(71) Applicant: LG CNS CO., LTD., Seoul (KR)

(72) Inventors: Jaeho Joo, Seoul (KR); Sean Kim, Seoul (KR); Rhea Kim, Seoul (KR); Tae Ho Youm, Seoul (KR)

(73) Assignee: LG CNS Co., Ltd., Seoul (KR)

( * ) Notice: Subject to any disclaimer, the term of this patent is extended or adjusted under 35 U.S.C. 154(b) by 1225 days.

(21) Appl. No.: 14/528,576

(22) Filed: Oct. 30, 2014

(65) Prior Publication Data

US 2016/0125664 A1 May 5, 2016

(51) Int. Cl.
*G07B 15/06* (2011.01)
*G07B 13/00* (2006.01)

(52) U.S. Cl.
CPC ..... *G07B 15/06* (2013.01); *G07B 13/00* (2013.01)

(58) Field of Classification Search
CPC ..... G07B 13/00; G07B 15/06; G07B 15/02; G06Q 30/0284; G06Q 30/02; G07F 17/0014; G07F 17/0021; G07F 7/0873
See application file for complete search history.

(56) References Cited

U.S. PATENT DOCUMENTS

2004/0112959 A1* 6/2004 Jun ..... G07B 13/04 235/384
2011/0047037 A1* 2/2011 Wu ..... G06Q 20/204 705/17
2012/0014299 A1* 1/2012 Yoon ..... H04L 43/0811 370/310
2013/0162430 A1* 6/2013 Scherzer ..... H04W 52/0261 340/539.13
2013/0185124 A1* 7/2013 Aaron ..... G07B 13/00 705/13
2014/0074757 A1* 3/2014 De Gennaro ..... G07B 13/04 705/417

FOREIGN PATENT DOCUMENTS

KR 10-0383159 5/2003
KR 10-2004-0050957 6/2004
KR 10-2012-0060030 6/2012

OTHER PUBLICATIONS

"Wireless Payment Terminals to Hit the Streets in Chicago Taxicabs," Atm & Debit News, vol. 4, pp. 1-2 (Year: 2003).*
Korean Office Action dated Jan. 15, 2016 issued in Application No. 10-2015-0057823.

* cited by examiner

*Primary Examiner* — Kevin H Flynn
*Assistant Examiner* — Brian Adams Heflin
(74) *Attorney, Agent, or Firm* — KED & Associates, LLP

(57) ABSTRACT

A system is provided for managing a mobile vehicle. The system may include: a first terminal that is located in the mobile vehicle and communicates with an external server by being connected to a communication network, and a second terminal that is located in the mobile vehicle and connected to the communication network through the first terminal. At least one of the first terminal and the second terminal is connected to at least one of a meter, a card reader, and a global positioning system (GPS) receiver, which are located in the mobile vehicle, through a connecting device. The first and second terminals may receive power from a power supply device.

12 Claims, 5 Drawing Sheets

SYSTEM FOR MANAGING MOBILE VEHICLE

BACKGROUND

1. Field

Embodiments may relate to a system for managing a mobile vehicle, and more particularly, to a system for managing a mobile vehicle that may be used to manage mobile vehicle services, to manage payment, and/or to provide convenience to a passenger.

2. Background

Public transportation, such as buses and subways, may be widely used due to low costs, whereas taxies may be widely used due to convenience and speed.

A passenger may get a taxi, tell a destination to a driver, pay a taxi fare with cash or a credit card when the taxi reaches the destination, and then get off the taxi.

Various services may be provided to the passenger for a passenger's convenience, but the passenger may still have to request the driver for a certain service. It may be difficult for the passenger to directly search for information related to a taxi service.

It may be difficult for a taxi company to manage incomes of taxies and histories of driving services of the taxies.

Accordingly, a method of efficiently managing taxies while increasing convenience of using the taxies may be desired.

BRIEF DESCRIPTION OF THE DRAWINGS

Arrangements and embodiments may be described in detail with reference to the following drawings in which like reference numerals refer to like elements and wherein.

DETAILED DESCRIPTION

Figure 1:
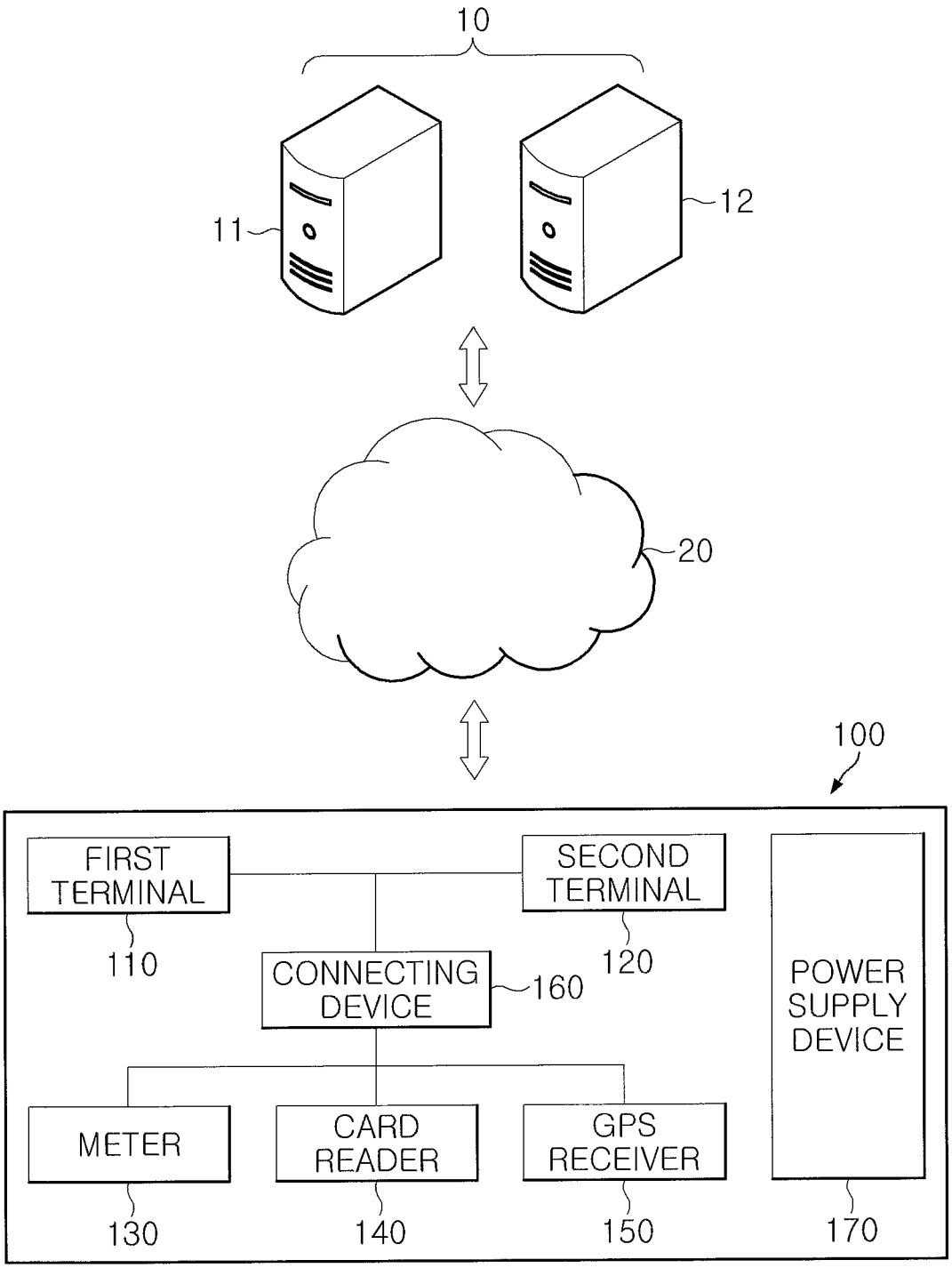
FIG. 1 is a diagram of a system for managing a mobile vehicle, according to an example embodiment.

Exemplary embodiments may be described in detail with reference to the accompanying drawings. While embodiments may be described in conjunction with exemplary embodiments thereof, it is to be understood that the present description is not intended to limit exemplary embodiments. On the contrary, embodiments are intended to cover not only the exemplary embodiments, but also various alternatives, modifications, equivalents and other embodiments that may be included within the spirit and scope of embodiments as defined by the appended claims. In drawings, like reference numerals denote like elements.

According to exemplary embodiments, the word "unit" may refer to a software component or hardware component such as an FPGA or ASIC capable of carrying out a function or an operation. However, "unit" is not limited to hardware or software. A unit may be configured so as to reside in an addressable storage medium or dto drive one or more processors. Units may refer to software components, object-oriented software components, class components, task components, processes, functions, attributes, procedures, subroutines, program code segments, drivers, firmware, microcode, circuits, data, databases, data structures, tables, arrays and/or variables. A function provided by a component and a unit may be a combination of smaller components and units, and may be combined with others to compose large components and units, and/or further divided into units along with other components.

In the present disclosure, 'a driving service of a mobile vehicle' may denote a service of a mobile terminal taking on a passenger and then moving the passenger from a departure point to a destination, and may not simply denote a mobile vehicle service from a beginning to an end of business of the mobile vehicle.

FIG. 1 is a diagram of a system for managing a mobile vehicle, according to an example embodiment. Other embodiments and configurations may also be provided.

Referring to FIG. 1, a system 100 may include a first terminal 110 and a second terminal 120.

The first terminal 110 and the second terminal 120 may each be any one of various types of terminals, such as a laptop, a smart phone, a tablet personal computer (PC), and/or a personal digital assistant (PDA), which are connectable to a predetermined communication network 20.

The first and second terminals 110 and 120 may be located in a mobile vehicle, such as a taxi. The first terminal 110 may be located at a driver region of the mobile vehicle, and the second terminal 120 may be located at a passenger region of the mobile vehicle. The driver region (of the mobile vehicle) may be a front space of an internal space of the mobile vehicle and the passenger region (of the mobile vehicle) may denote a rear space of the internal space of the mobile vehicle. For example, the first terminal 110 may be located at a dash board of the mobile vehicle and the second terminal 120 may be located at a back of a front seat, although locations of the first and second terminals 110 and 120 are not limited thereto.

A driver application for the driver may be installed (or provided) in a memory of the first terminal 110, and/or a passenger application of the passenger may be installed (or provided) in a memory of the second terminal 120. A processor of the first terminal 110 and a processor of the second terminal 120 may perform certain operations according to controls of the driver application and the passenger application, respectively.

The first and second terminals 110 and 120 may communicate with an external server 10, such as a center server 11 and a card server 12, by being connected to the external server 10 through the predetermined communication network 20.

The system 100 may further include at least one of a meter 130, a card reader 140, and a global positioning system (GPS) receiver 150, which are located in the mobile vehicle. The meter 130 may calculate a fare of the mobile vehicle based on fare calculation data that includes at least one of moving distance data and moving time data from a departure point to a destination. The card reader 140 may receive card information input by the passenger. The GPS receiver 150 may measure (or determine) a location of the mobile vehicle. The meter 130 may be located at the driver region along with the first terminal 110 The card reader 140 may be located at the passenger region along with the second terminal 120.

The meter 130 may store a fare calculation program for calculating the fare of the mobile vehicle based on the fare calculation data.

At least one of the meter 130, the card reader 140, and the GPS receiver 150 may be connected to at least one of the first and second terminals 110 and 120 through a connecting device 160. At least one of the first and second terminals 110 and 120 may receive data from at least one of the meter 130, the card reader 140, and the GPS receiver 150.

A power supply device 170 may supply power to the first and second terminals 110 and 120, and may include a direct current (DC)-DC converter. For example, the power supply device 170 may transform a voltage applied from a battery of the mobile vehicle and supply the transformed voltage to the first and second terminals 110 and 120.

Operations of each component included in the system 100 may be described in detail based on a driving service of the mobile vehicle (including the system 100).

Preparing to Use System 100

In order to use the system 100, the first and second terminals 110 and 120 may be registered in the center server 11. When the first and second terminals 110 and 120 connect to the center server 11 through the predetermined communication network 20, a device number (i.e., a serial number) of each of the first and second terminals 110 and 120 may be transmitted to the center server 11 such that each of the first and second terminals 110 and 120 is registered in the center server 11.

Additionally, each of the first and second terminals 110 and 120 may transmit a device number of at least one of the meter 130, the GPS receiver 150, and the card reader 140, located in the mobile vehicle, to the center server 11 such that the at least one of the meter 130, the GPS receiver 150, and the card reader 140 is also registered in the center server 11.

Any one of the first and second terminals 110 and 120 may authorize the center server 11. For example, any one of the first and second terminals 110 and 120 may authorize the center server 11 based on an internet protocol (IP) address of the center server 11 or a certificate stored in the center server 11, thereby determining whether the center server 11 is an authentic center server.

Before driving the mobile vehicle, the driver may input login information to the first terminal 110, and the first terminal 110 may load or store driving information of the mobile vehicle with respect to the driver based on the input login information.

Taking on Passenger

When the passenger gets on the mobile vehicle and a destination is determined, the driver may manipulate the meter 130 to start a driving service, and input a rate for a fare of the mobile vehicle. The passenger may input a destination information to the second terminal 120, and the second terminal 120 may transmit the destination information to the first terminal 110. The driver may input a total number of passengers to the first terminal 110. The meter 130 may transmit data indicating that the driving service started to at least one of the first and second terminals 110 and 120.

When the driving service starts, the second terminal 120 may output prologue data, for example, video data and/or sound data, indicating that the driving service of the mobile vehicle has started.

Starting Driving Service

While driving to the destination, the driver may input a toll fee to the first terminal 110, and the first terminal 110 may reflect the toll fee (input by the driver) to the fare of the mobile vehicle.

The second terminal 120 may receive and store various types of multimedia contents from the center server 11. The passenger may manipulate the second terminal 120 to reproduce multimedia content stored in the second terminal 120. Examples of the multimedia contents may include not only video data (such as movies, television (TV) series, music videos), but also audio data (such as songs). The passenger may check weather or look at a map through the second terminal 120. The passenger may also check whether the mobile vehicle is currently located on the map through the second terminal 120, and according to at least one embodiment, the passenger may check a moving route of the mobile vehicle.

The passenger may manipulate the second terminal 120 to check (or obtain) information about the mobile vehicle and/or about the driver, thereby checking (or obtaining) whether the mobile vehicle is a registered vehicle and whether the driver driving the mobile vehicle is a registered driver.

The passenger may pay the fare of the mobile vehicle after the mobile vehicle reaches the destination, but according to the system 100, the passenger may request to pay the fare of the mobile vehicle in advance even before the mobile vehicle reaches the destination. More specifically, if the passenger requests to pay the fare in advance through the second terminal 120, the second terminal 120 may display a message requesting the passenger to input card information to the card reader 140, and the passenger may input the card information to the card reader 140 by tagging or swiping a card on the card reader 140. The card reader 140 may transmit the card information to the second terminal 120, and the second terminal 120 may transmit the card information and fare information of the mobile vehicle to the card server 12 after the driving service is ended and may receive a payment authorization of the fare of the mobile vehicle.

Ending Driving Service

When the mobile vehicle reaches the destination, the driver may input, to the meter 130, that the driving service has ended. The meter 130 may transmit fare data obtained based on fare calculation data (including at least one of moving distance data and moving time data of the mobile vehicle from the departure point to the destination) to the first terminal 110, and the first terminal 110 checks (or obtains) the fare data. While checking (or obtaining) the fare data, the first terminal 110 may change the fare data received from the meter 130 by considering the toll fee input by the driver while providing the driving service.

The first terminal 110 may transmit the fare data of the mobile vehicle to the second terminal 120, and the second terminal 120 may output the fare data on a screen of the second terminal 120. While outputting the fare data, the second terminal 120 may further output payment options for the fare. Examples of the payment options may include cash payment and credit card payment, although embodiments are not limited thereto.

When the passenger selects a credit card payment, the second terminal 120 may output (or display) a message requesting the passenger to input the card information to the card reader 140, and additionally may output (or display) a selection menu for a tip.

When the passenger inputs the card information to the card reader 140, the second terminal 120 receives the card information (from the card reader 140) and transmits the card information to the card server 12 to receive payment authorization of the fare. When payment normally ends, the second terminal 120 transmits a result of the payment authorization (indicating the payment normally ended) to the first terminal 110. The first terminal 110 stores information that the driving service ended and paid fare information, and the first terminal 110 may transmit such information to the center server 11 so that an income history is managed (or stored) by the center server 11.

Ending Service

If the driver wants to stop providing a driving service for awhile, the driver may select an off-duty menu so that the passenger does not get on the mobile vehicle. If the driver wants to stop driving the mobile vehicle, the driver may select a logout menu displayed on a screen of the first terminal 110.

Others

The first terminal 110 may receive a message transmitted for the driver from the center server 11, and the first terminal 110 may display the message on the screen for the driver.

The driver may check (or obtain) driving record information and income information through the first terminal 110, and the first terminal 110 may transmit the driving record information and the income information to the center server 11 so that a manager of the center server 11 may efficiently manage the mobile vehicle. The driving record information may include a departure point, a destination, a departure time, and/or an arrival time. The income information may include paid fare information of each driving service.

The second terminal 120 may operate in a disabled person mode for a person who is visually impaired, for example. The passenger may manipulate the second terminal 120 to operate in the disabled person mode. The second terminal 120 may auditorily output information related to a driving service, such as a payment, for the passenger's convenience.

Connection structures of components included in the system 100 may now be described in detail with respect to FIGS. 2 through 5.

Figure 2:
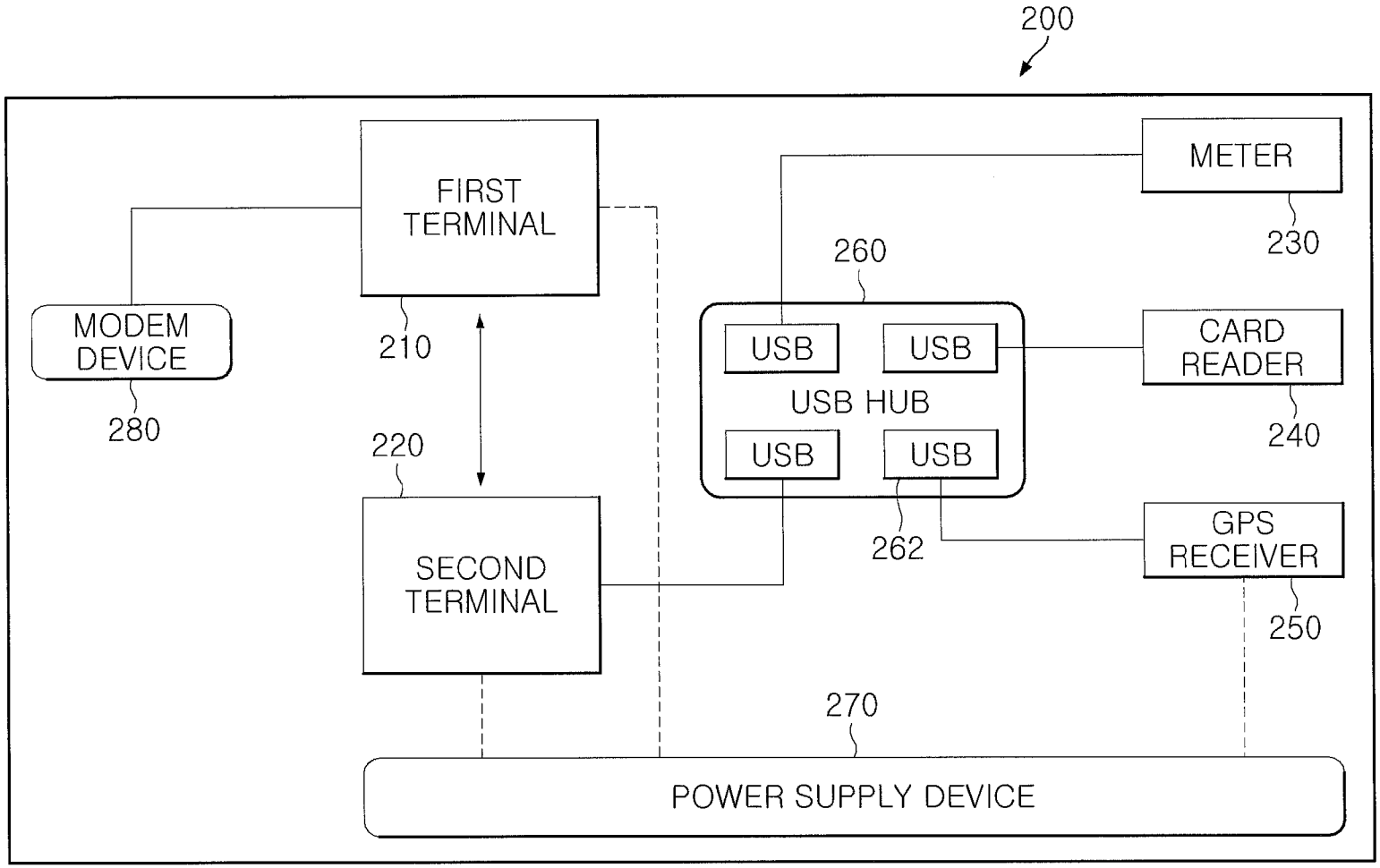
FIG. 2 is a diagram for describing a first connection relationship in a system for managing a mobile vehicle, according to an example embodiment.

FIG. 2 is a diagram for describing a first connection relationship in a system 200 for managing a mobile vehicle, according to an example embodiment. Other embodiments and configurations may also be provided.

A first terminal 210 may be connected to a modem device 280 via wires, and the first terminal 210 may be connected to the predetermined communication network 20 through the modem device 280. The modem device 280 may include a WiFi hotspot, a WiFi access point, and/or a WiFi egg.

A second terminal 220 may be connected to the predetermined communication network 20 through the first terminal 210, and may be connected to the predetermined communication network 20 via a tethering connection with the first terminal 210.

At least one of a meter 230, a card reader 240, and a GPS receiver 250 may be connected to the second terminal 220 through a universal serial bus (USB) hub 260. The USB hub 260 may include a plurality of USB ports 262, and at least one of the meter 230, the card reader 240, and the GPS receiver 250 may transmit obtained data to the second terminal 220 through the USB hub 260.

The second terminal 220 may transmit, to the first terminal 210, data to be transmitted to the first terminal 210, and data to be transmitted to the card server 12 to the card server 12, from among the data received from at least one of the meter 230, the card reader 240, and the GPS receiver 250.

For example, when fare data of the mobile vehicle is received from the meter 230, the second terminal 220 may transmit the fare data to the first terminal 210, or the second terminal 220 may receive fare data from the first terminal 210 and display the fare data on a screen of the second terminal 220.

Alternatively, when card information is received from the card reader 240, the second terminal 220 may transmit the card information to the card server 12, and the second terminal 220 may receive payment authorization of the fare of the mobile vehicle from the card server 12.

Dashed lines in FIG. 2 may denote paths of power, and as shown in FIG. 2, a power supply device 270 may directly supply power to the first and second terminals 210 and 220, and any one of the meter 230, the card reader 240, and the GPS receiver 250.

Figure 3:
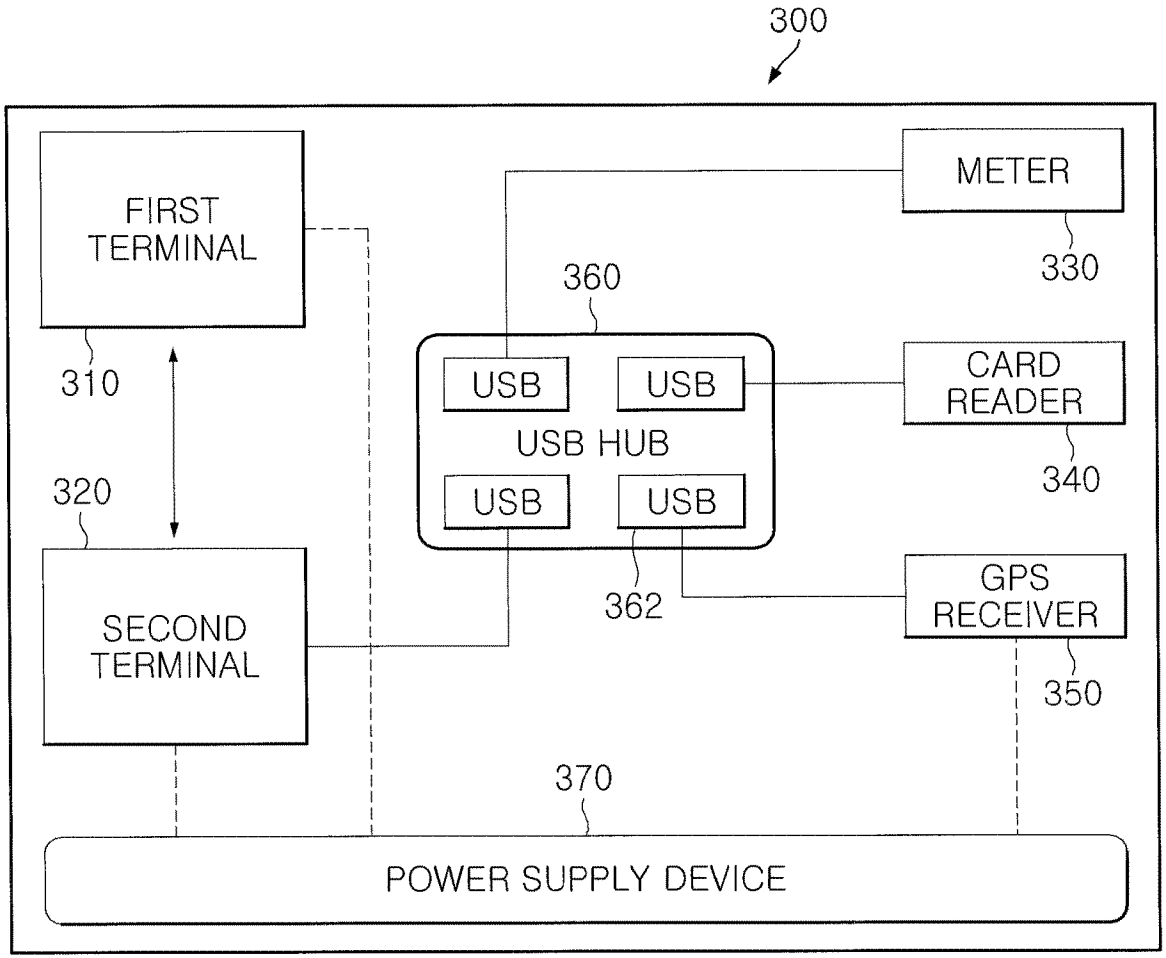
FIG. 3 is a diagram for describing a second connection relationship in a system for managing a mobile vehicle, according to an example embodiment.

FIG. 3 is a diagram for describing a second connection relationship in a system 300 for managing a mobile vehicle, according to an example embodiment. Other embodiments and configurations may also be provided.

Referring to FIG. 3, unlike the first connection relationship (of FIG. 2), the modem device 280 is not included in the second connection relationship. According to the second connection relationship, a first terminal 310 may be connected to the predetermined communication network 20 through a communication module included in the first terminal 310. The predetermined communication network 20 may be a mobile communication network provided by a mobile carrier. Examples of the mobile communication network may be a 3rd-generation (3G) network and a long-term evolution (LTE) network.

Figure 4:
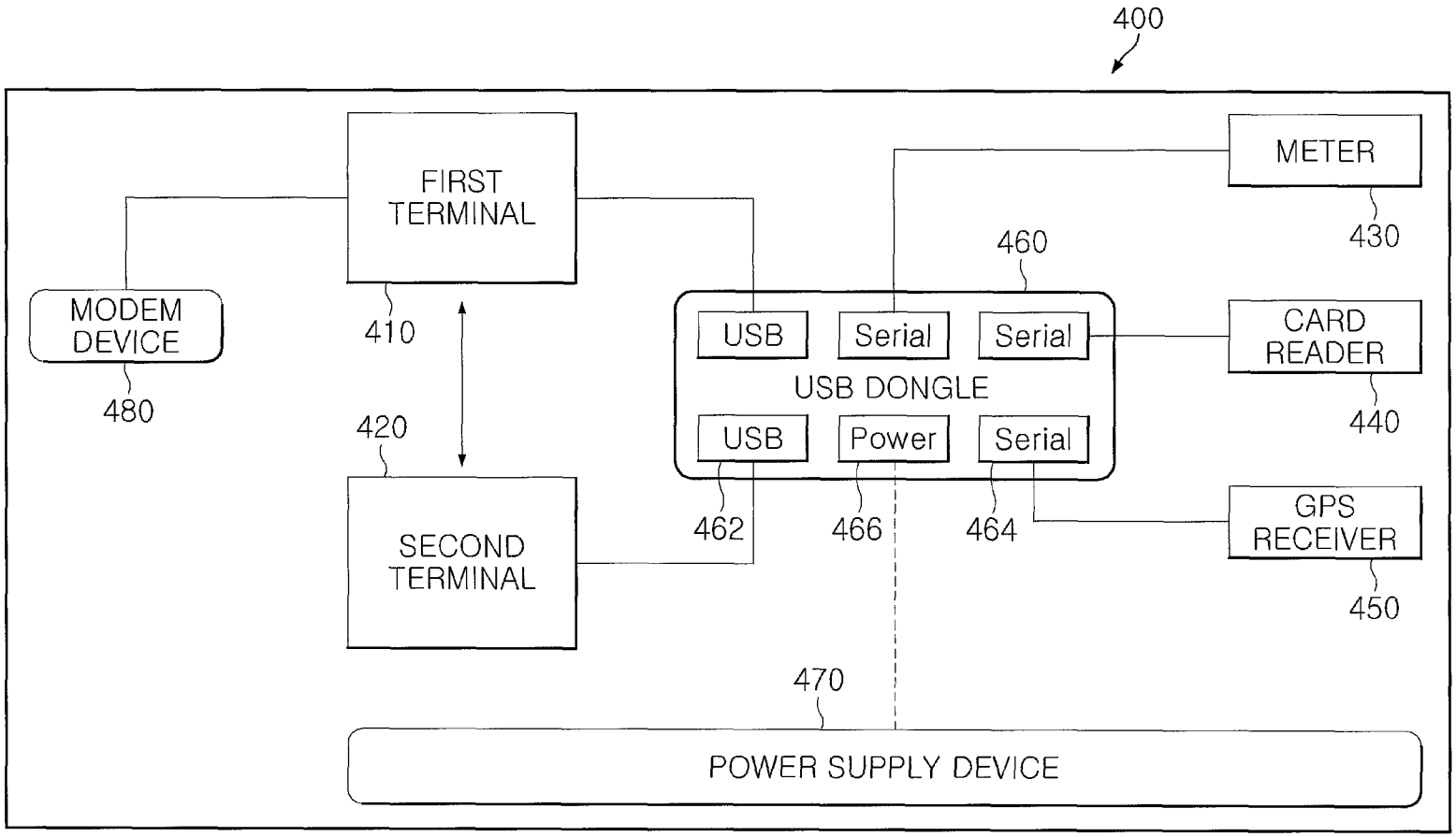
FIG. 4 is a diagram for describing a third connection relationship in a system for managing a mobile vehicle, according to an example embodiment.

FIG. 4 is a diagram for describing a third connection relationship in a system 400 for managing a mobile vehicle, according to an example embodiment. Other embodiments and configurations may also be provided.

A first terminal 410 may be connected to a modem device 480 via wires, and may be connected to the predetermined communication network 20 through the modem device 480. The modem device 480 may include a WiFi hotspot, a WiFi access point, and/or a WiFi egg, for example.

A second terminal 420 may be connected to the predetermined communication network 20 through the first terminal 410, and the second terminal 420 may be connected to the predetermined communication network 20 via a tethering connection with the first terminal 410.

At least one of a meter 430, a card reader 440, and a GPS receiver 450 may be connected to the first and second terminals 410 and 420 through a USB dongle 460. The USB dongle 460 may include a plurality of USB ports 462 and a plurality of serial ports 464, and the first and second terminals 410 and 420 may be connected to any one of the meter 430, the card reader 440, and the GPS receiver 450 through the plurality of USB ports 462 and the plurality of the serial ports 464.

At least one of the meter 430, the card reader 440, and the GPS receiver 450 may transmit obtained data to the second terminal 420. As described above, the second terminal 420 may transmit, to the first terminal 410, data to be transmitted to the first terminal 410 and data to be transmitted to the card server 12 to the card server 12, from among the data received from at least one of the meter 430, the card reader 440, and the GPS receiver 450.

According to at least one embodiment, at least one of the meter 430, the card reader 440, and the GPS receiver 450 may transmit obtained data to the first terminal 410, and at this time, the first terminal 410 may transmit, to the second terminal 420, data to be transmitted to the second terminal 420 and data to be transmitted to the card server 12 to the card server 120, from among the data received from at least one of the meter 430, the card reader 440, and the GPS receiver 450.

According to at least one embodiment, at least one of the meter 430, the card reader 440, and the GPS receiver 450 may select a target (i.e., the first or second terminal 410 or 420) to receive obtained data, and then transmit the obtained data to the selected target.

A dashed line in FIG. 4 may denote a path of power, and as shown in FIG. 4, a power supply device 470 may supply power to a power port 466 of the USB dongle 460 so as to supply power to the first and second terminals 410 and 420 and to any one of the meter 430, the card reader 440, and the GPS receiver 450, through the USB dongle 460. The USB dongle 460 may be used to supply power, and may transmit and receive data.

Figure 5:
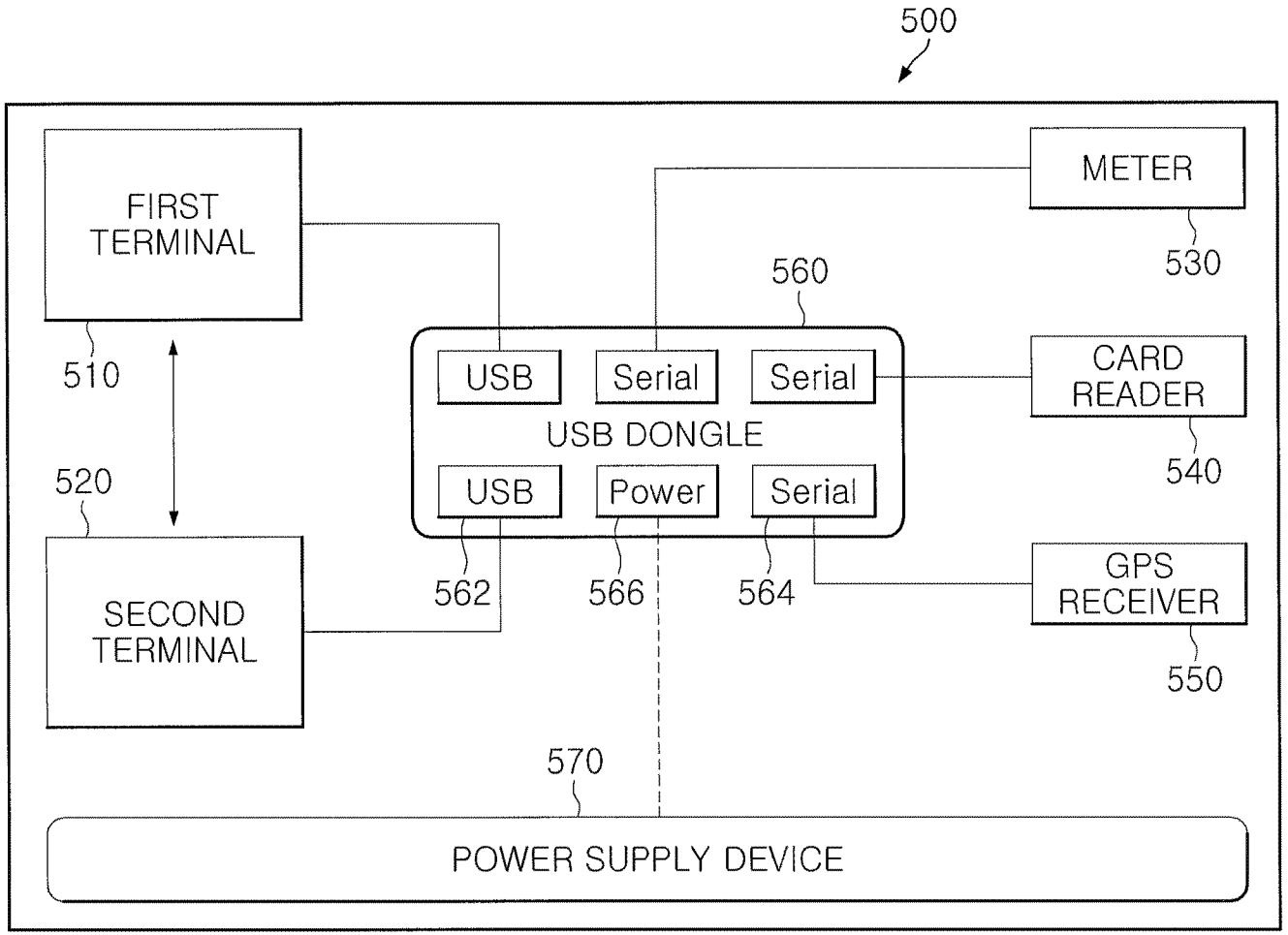
FIG. 5 is a diagram for describing a fourth connection relationship in a system for managing a mobile vehicle, according to an example embodiment.

FIG. 5 is a diagram for describing a fourth connection relationship in a system 500 for managing a mobile vehicle, according to an example embodiment. Other embodiments and configurations may also be provided.

Referring to FIG. 5, unlike the third connection relationship of FIG. 4, the modem device 480 is not included in the fourth connection relationship. According to the fourth connection relationship, a first terminal 510 may be connected to the predetermined communication network 20 through a communication module included in the first terminal 510. The predetermined communication network 20 may be a mobile communication network provided by a mobile carrier. Examples of the mobile communication network may be a 3G network and an LTE network.

According to the third and fourth connection relationships, the second terminals 420 and 520 may not be included in the systems 400 and 500. In this example, the first terminals 410 and 510 may directly receive and process data from any one of the meters 430 and 530, the card readers 440 and 540, and the GPS receivers 450 and 550.

The first terminals 410 and 510 may receive and check fare data of the mobile vehicle from the meters 430 and 530, and when card information of the passenger is received from the card readers 440 and 540, the first terminals 410 and 510 may transmit the card information to the card server 12 and receive a payment authorization of a fare of the mobile vehicle from the card server 12.

A system for managing a mobile vehicle, according to an example embodiment, may increase convenience of a passenger who uses the mobile vehicle.

A system for managing a mobile vehicle, according to an example embodiment, may enable a mobile vehicle operating company to easily manage the mobile vehicle.

A system for managing a mobile vehicle, according to an example embodiment, may efficiently connect several apparatus (located in the mobile vehicle) to each other.

The above-described embodiments may be drafted (or provided) into computer-executable programs, and may be embodied within a conventional digital computer for operating the program using a computer-readable recording medium.

The computer-readable recording medium may include storage media such as a magnetic storage medium (e.g., ROMs, floppy disks, hard disks, etc.), an optically readable medium (e.g., CD ROMs, DVDs, etc.), and a carrier wave (e.g., transmission via the internet).

One or more embodiments may include a system for managing a mobile vehicle that increases convenience of a passenger who use the mobile vehicle.

One or more embodiments may include a system for managing a mobile vehicle that enables a mobile vehicle operating company to easily manage the mobile vehicle.

One or more embodiments may include a system for managing a mobile vehicle that efficiently connects several apparatus (located in the mobile vehicle) to each other.

According to one or more embodiments, a system for managing a mobile vehicle may include a first terminal that is located in the mobile vehicle to communicate with an external server by being connected to a predetermined communication network, and a second terminal that is located in the mobile vehicle to connect to the predetermined communication network through the first terminal. At least one of the first terminal and the second terminal is connected to at least one of a meter, a card reader, and a global positioning system (GPS) receiver, which are located in the mobile vehicle, through a connecting device. The first and second terminals may receive power from a power supply device.

The first terminal may be connected a modem device and may be connected to the predetermined communication network through the modem device.

The predetermined communication network may include a mobile communication network. The first terminal may be connected to the mobile communication network through a communication module included in the first terminal.

The second terminal may be connected to the predetermined communication network via a tethering connection with the first terminal.

The connecting device may include a universal serial bus (USB) hub.

At least one of the meter, the card reader, and the GPS receiver may be connected to only the second terminal through the USB hub. The second terminal may transmit data received from any one of the meter, the card reader, and the GPS receiver to the first terminal.

The second terminal may receive fare data of the mobile vehicle from the meter and transmit the received fare data to the first terminal. The first terminal may transmit the fare data of the mobile vehicle to the second terminal such that the second terminal displays a fare of the mobile vehicle.

When card information of a passenger is received from the card reader, the second terminal may transmit the card information to a card server connected to the predetermined communication network and receive a payment authorization of a fare of the mobile vehicle from the card server.

The connecting device may include a USB dongle. The first and second terminals may receive power from the power supply device through the USB dongle.

When the meter, the card reader, and the GPS receiver are connected to the first terminal through the USB dongle, the first terminal may receive data from any one of the meter, the card reader, and the GPS receiver.

When information that a driving service has started is input to the meter by a driver, the second terminal may output predetermined multimedia data according to an input of a passenger.

According to one or more embodiments, a system for managing a mobile vehicle may include a first terminal that communicates with an external server by being connected to a predetermined communication network, and is connected to at least one of a meter, a card reader, and a global positioning system (GPS) receiver, which are located in the mobile vehicle, to receive data from at least one of the meter, the card reader, and the GPS receiver. The first terminal may be connected to at least one of the meter, the card reader, and the GPS receiver through a connecting device. The first terminal receives power from a power supply device.

When fare data of the mobile vehicle is received from the meter, the first terminal may display a fare of the mobile vehicle. When card information of a passenger is received from the card reader, the first terminal may transmit the card information to a card server connected to the predetermined communication network and receive a payment authorization of the fare of the mobile vehicle from the card server.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A system for managing a mobile vehicle, the system comprising:

a first terminal provided at the mobile vehicle to communicate with an external server via a communication network; and a second terminal provided at the mobile vehicle to connect to the communication network through the first terminal;

a Universal Serial Bus (USB) device to connect to the second terminal, and the USB device to separately connect to each of a meter, a card reader, and a global positioning system (GPS) receiver, which are in the mobile vehicle, wherein the meter, the card reader, and the GPS receiver are each separately connected to the second terminal only through the USB device, wherein information from a first one of the meter, the card reader and the GPS receiver is provided via the USB device to the second terminal, and the second terminal to transmit, to the first terminal, the information from the first one of the meter, the card reader and the GPS receiver, and the first terminal and the second terminal receive power from a power supply device, wherein when at least one of the meter, the card reader, and the GPS receiver is connected to the first terminal through the USB device, the first terminal receives data from the at least one of the meter, the card reader, and the GPS receiver.

2. The system of claim 1, wherein the first terminal is connected to a modem device, and the first terminal is connected to the communication network through the modem device.

3. The system of claim 1, wherein the communication network is a mobile communication network, and the first terminal includes a communication module, wherein the first terminal is connected to the mobile communication network through the communication module of the first terminal.

4. The system of claim 1, wherein the second terminal is connected to the communication network via a tethering connection with the first terminal.

5. The system of claim 1, wherein the USB device includes a universal serial bus (USB) hub.

6. The system of claim 1, wherein the second terminal receives first fare data from the meter, and the second terminal transmits the first fare data to the first terminal, and the first terminal transmits second fare data reflecting a toll free to the second terminal, and the second terminal displays a fare of the mobile vehicle based on the second fare data.

7. The system of claim 1, wherein when card information of a passenger is received, at the second terminal, from the card reader, the second terminal transmits the card information to a card server connected to the communication network and the second terminal receives a payment authorization of a fare from the card server.

8. The system of claim 1, wherein the USB device includes a USB dongle, wherein the first and second terminals receive power from the power supply device through the USB dongle.

9. The system of claim 1, wherein when information that a driving service has started is input to the meter, the second terminal outputs multimedia data based on an input of a passenger.

10. A mobile vehicle system comprising:

a first terminal to communicate via a communication network; and a second terminal to connect to the communication network through the first terminal;

a meter;

a card reader;

a global positioning system (GPS) receiver;

a Universal Serial Bus (USB) connecting device to separately provide data from each of the meter, the card reader and the GPS receiver to the second terminal, wherein the meter, the card reader and the GPS receiver are each separately connected to the second terminal only through the USB connecting device, wherein information from a first one of the meter, the card reader and the GPS receiver is provided via the USB connecting device to the second terminal, and the second terminal to transmit, to the first terminal, the information from the first one of the meter, the card reader and the GPS receiver, wherein when at least one of the meter, the card reader, and the GPS receiver is connected to the first terminal through the USB connecting device, the first terminal receives data from the at least one of the meter, the card reader, and the GPS receiver.

11. The system of claim 10, wherein the first terminal is connected to a modem device, and the first terminal is connected to the communication network through the modem device.

12. The system of claim 10, wherein the USB connecting device is one of a USB hub and a USB dongle.

* * * * *